United States Patent [19]

Goubaud

[11] Patent Number: 4,555,982

[45] Date of Patent: Dec. 3, 1985

[54] ROOF VENTILATOR

[76] Inventor: Michel Goubaud, 359 Bd Léon Séché 44150 Ancenis, France

[21] Appl. No.: 577,718

[22] Filed: Feb. 7, 1984

[30] Foreign Application Priority Data

Feb. 11, 1983 [FR] France ..... 83 02200

[51] Int. Cl.[4] ..... F24F 7/02

[52] U.S. Cl. ..... 98/42.22; 98/121.1

[58] Field of Search ..... 52/199; 98/42, 121

[56] References Cited

U.S. PATENT DOCUMENTS

| | | | |
|---|---|---|---|
| 1,424,566 | 8/1922 | Griffiths | 52/199 |
| 1,995,514 | 3/1935 | Martin | 98/121 R X |
| 2,973,704 | 3/1961 | Flanagan | 98/42 R |
| 3,238,862 | 3/1966 | Smith et al. | 98/42 R |
| 4,109,433 | 8/1978 | Maze | 98/42 A X |

FOREIGN PATENT DOCUMENTS

| | | | |
|---|---|---|---|
| 66838 | 12/1982 | European Pat. Off. | 42 A/ |

*Primary Examiner*—Harold Joyce
*Attorney, Agent, or Firm*—Charles E. Brown

[57] ABSTRACT

A roof ventilator comprises a base plate insertable in a roof assembly and having an opening receiving a panel leaving a free passageway at the lower end. The panel having a plurality of pairs of transverse louvers defining louver openings. Alternate louvers extend outwardly and upwardly and outwardly and downwardly from the panel, the cross-sectional area of the louver openings tapers outwardly and the endmost louvers converge outwardly of the panel. A projecting ridge is formed in the base plate beyond the lower transverse edge of the passageway and has an upper side which is connected by a step to an inclined section of the bottom wall of a duct communicating both with the louver openings and passageway and the attic or rooms below. Irrespective of the direction of currents of air flowing along the roof negative pressure is produced inside the duct.

29 Claims, 9 Drawing Figures

FIG. 1
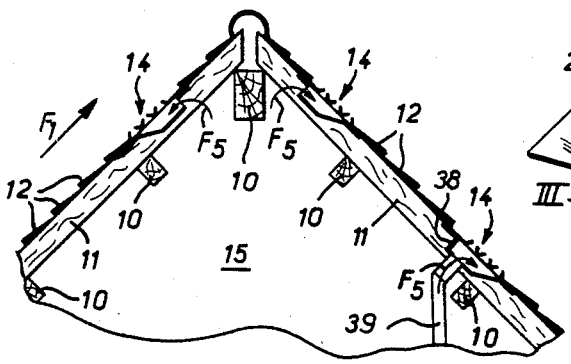
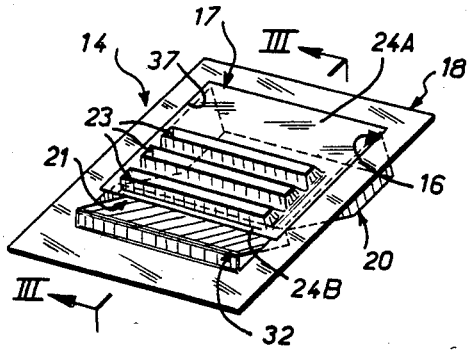
FIG. 2
FIG. 3
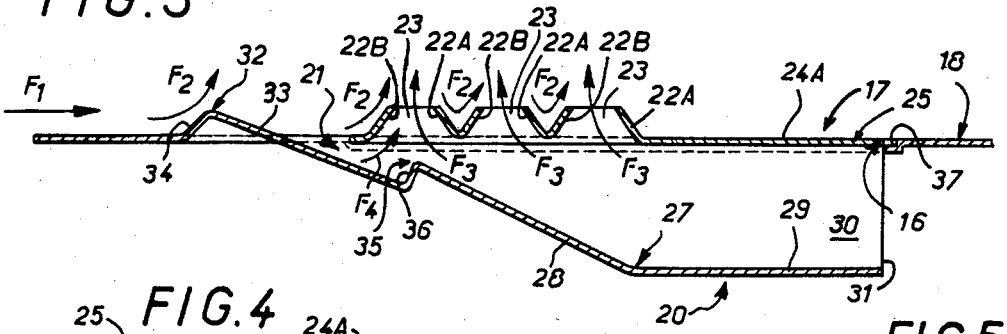
FIG. 4
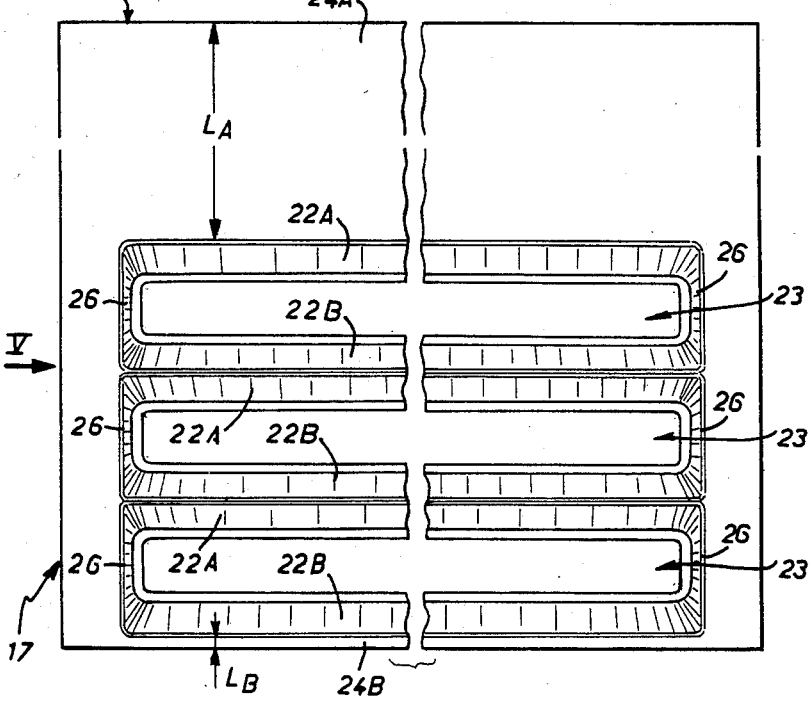
FIG. 5
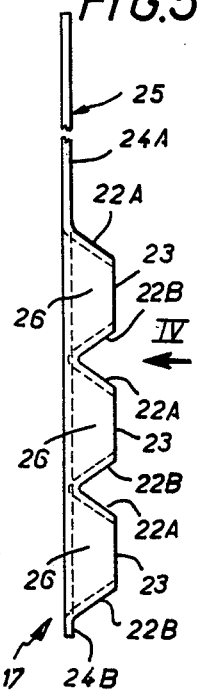

ROOF VENTILATOR

BACKGROUND OF THE INVENTION

The present invention relates generally to roofs, and more particularly to ventilators of the kind which are mounted in a roof and lie in the general plane thereof in place of one or more roofing elements, such as tiles, shingles or slates.

As is known, such ventilators are usually employed to ensure the ventilation of the space subjacent the roof to overcome the consequences of the inevitable condensation due to the difference between the interior temperature and the exterior temperature. Failing such ventilation, rapid deterioration, by rotting, of the frame or structural work and of the conventional insulation usually associated with the frame, is to be feared. The prior protective impregnation of the frame, in addition, reduces the effectiveness of such insulation.

Such ventilators may be employed in combination with suitable ducting to ventilate rooms of lower floors of the associated building and/or to exhaust fumes or foul air originating in such rooms.

Generally such ventilators comprise an opening for the desired flow of air. To prevent the entrance of foreign matter such as dead leaves or animals, it is common to at least partially close off the opening with an apertured panel, screen or grating. Most often the panel lies vertically so that the ventilator which extends at an angle relative to the panel to avoid direct admission of rain or snow for example, causes the panel to protrude substantially outwardly beyond the general plane of the roof to the detriment of the overall harmony of the roof.

In U.S. Pat. No. 2,973,704, however, it was proposed to arrange the apertured panel in the very plane of the roof. But to avoid or at least reduce the direct admission of rain or snow and to overcome the consequences of the entrance of the same, two related features were adopted.

According to a first feature the apertured panel comprised a plurality of inclined louvers. The second feature consists in leaving a passage of reduced cross-sectional area at the lower or downstream part of the opening and to arrange in the subjacent space and in continuity with the opening, a duct having a bottom wall which at least at its lower or downstream end is inclined toward the lower transverse edge of the opening and joined thereto so that all moisture, rain or snow, which enters through the opening is collected by the duct and carried back to the roof.

In the foregoing U.S. Pat. No. 2,973,704, the louver openings angle outwardly and upwardly with the exception of the lowermost louver opening which angles outwardly and downwardly to exhaust any moisture collected by the duct.

This arrangement is satisfactory in the absence of wind. Such is not the case when there are windy conditions and all the more so when winds are high.

In such cases the admission of snow or rain may be observed through the louver opening at the bottom of the panel when the wind produces an induced current of air which rises along the roof and through the other louver openings in the panel when the induced current of air flows downwards along the roof. A sufficiently large amount of precipitation may collect in the duct to cause the moisture to gain the subjacent space below the roof without it being possible to exhaust the same.

To reduce this drawback U.S. Pat. No. 2,973,704 provides deflectors or baffles above the uppermost louver and below the lowermost louver. The effectiveness of such deflectors or baffles is uncertain. Further, as these deflectors or baffles are separate parts from the rest of the panel their mounting complicates and increases the cost of installation of such a ventilator.

OBJECT AND SUMMARY OF THE INVENTION

An object of the present invention is to provide a roof ventilator which avoids the foregoing drawbacks and has additional advantages.

According to the invention there is provided a roof ventilator comprising means defining an opening at least partially covered by a panel. The panel has a plurality of pairs of transverse louvers defining louver openings. Alternating louvers slope in different directions. The endmost louvers converge outwardly of the panel and the cross section of the louver openings tapers outwardly.

The risks of admission of precipitation in the case of windy conditions are minimized or even eliminated despite the fact that the louver openings open outwardly and upwardly or outwardly and downwardly.

Relative terms such as "outwardly", "upwardly" and "downwardly" are used in the description and claims for the sake of convenience only and refer to the orientation of the ventilator when installed in a roof. Likewise terms such as "upstream" and downstream" refer to the general direction of the flow of air through the ventilator to the surroundings when the roof ventilator is installed.

In the vicinity of the louver openings, owing to the slope of the louvers, the current of air produced by wind along the roof is deflected upwards whether the current of air rises or falls. The current of air in turn induces airflow out of the ventilator through the louver openings.

The novel roof ventilator comprises as is known per se a base plate for installing the ventilator in a roof. The louvered panel is arranged in the opening in the base plate. The panel covers the large, upstream or upper part of the opening leaving a passageway of smaller width at the downstream or lower part of the opening. Under the base plate is a duct which is in continuity with the opening and at least the downstream or lower end of the bottom wall of slopes toward and joins the downstream or lower end of the opening in the base plate. In case of wind the duct is under negative pressure, the resulting airflow from the interior of the ventilator to the surroundings then opposes the admission of precipitation into the ventilator.

The room ventilating or exhausting capacity of the ventilator is also enhanced.

Preferably, the free passageway at the downstream or lower end of the opening is also affected by the suction effect produced in the louver openings. The base plate includes a projecting ridge having a upstream or upper side which is substantially in continuity with the inclined section of the bottom wall of the duct and the downstream or lower side slopes in the same direction as the downstream or lowermost louver of the panel.

As it is an integral part of the ventilator the projecting ridge does not require any additional mounting or assembly operation.

Preferably, for contributing to the suction capacity the bottom wall of the duct forms a projecting step in vertical alignment with at least one of the louver openings, preferably the downstream or lowermost louver opening.

Preferably, at least one of the endmost louvers of the panel and in practice the both endmost louvers are in continuity at their bases with flat cross members lying in the plane of the base plate of the ventilator.

At the uppermost louver the flat cross member is relatively wide and closes off the duct of the ventilator. At the lowermost louver, the flat cross member borders on the relatively narrow passageway and may also be relatively narrow.

But it seems that the lower cross member plays a substantial part in the obtention of the sought-after result and apparently it deflects any rising currents of air and directs them toward the adjoining louver and thereby opposes penetration of the currents of air into the passageway.

Of course, as is known per se, the passageway exhausts any moisture which may have nonetheless reached the duct, for example, in case of precipitation which is not accompanied with wind.

BRIEF DESCRIPTION OF THE DRAWINGS

These and other features and advantages of the invention will become apparent from the description which follows, given by way of example, with reference to the accompanying diagrammatic drawings.

FIG. 1 is a fragmentary vertical cross-sectional view of a roof equipped with roof ventilators embodying the present invention;

FIG. 2 is a perspective view of one such roof ventilator taken on its own;

FIG. 3 is a larger scale cross sectional view, disposed horizontally of the roof ventilator, taken on line III—III in FIG. 2;

FIG. 4 is a fragmentary top plan view of the panel of the ventilator, viewed in the direction of arrow IV in FIG. 5; and FIG. 5 is a fragmentary side elevational view taken in the direction of arrow V in FIG. 4;

DESCRIPTION OF THE PREFERRED EMBODIMENTS

Figure 6:
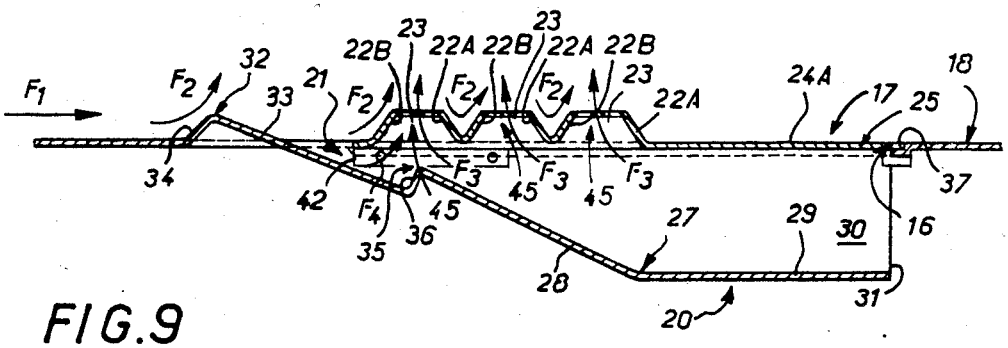
FIGS. 6, 7 and 8 are views similar to those of FIGS. 3, 4 and 5 for an alternative embodiment of the ventilator, FIG. 7 being a top plan view taken in the direction of arrow VII in FIG. 8, FIG. 8 being a side elevational view in the direction of arrow VIII in FIG. 7.
Figure 9:
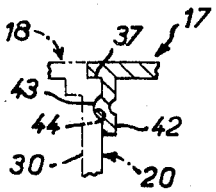
FIG. 9 is a fragmentary view, on a different scale, taken on the line IX—IX in FIG. 7.
Figure 7:
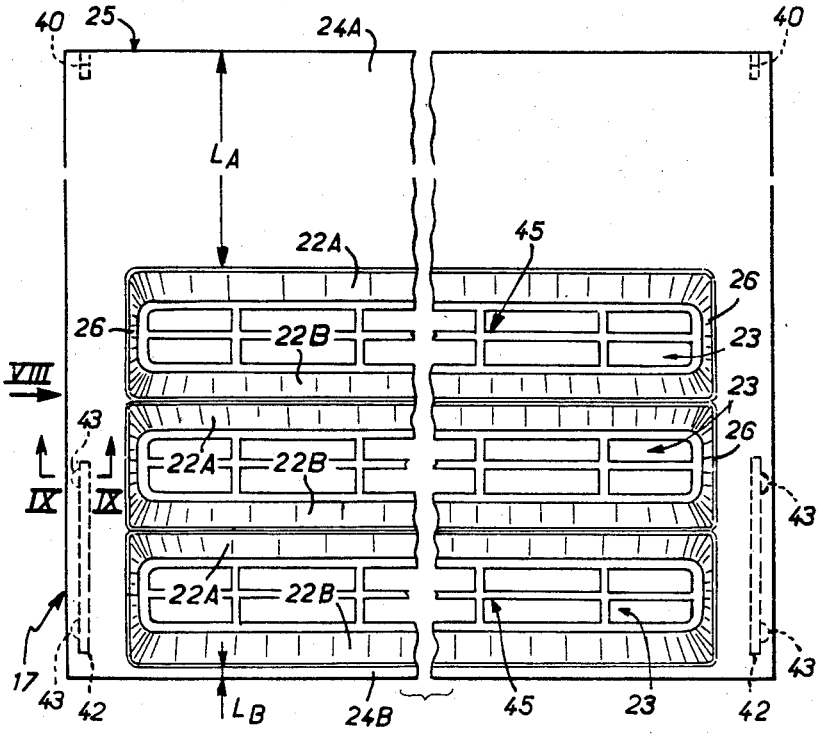
Figure 8:
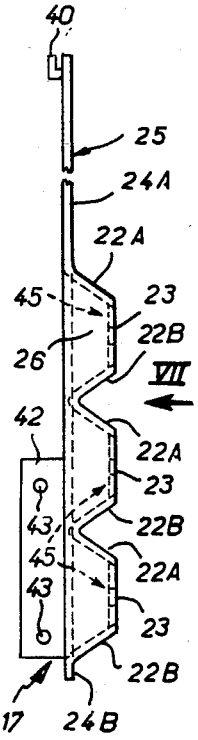

In FIG. 7 is illustrated a roof namely a gable roof having a frame or support structure comprising rafters 11 and purloins 10.

The actual roof comprises roofing elements 12 such as tiles, slates or shingles secured in a suitable manner by nailing, stapling or clipping to the roof lath or batten (not shown) which in turn is affixed to the rafters 11.

In place of one or more roofing elements 12 at spaced locations are installed one or more roof ventilators 14.

As illustrated in FIG. 1 three such ventilators 14 are provided. Two ventilators 14 are installed proximate to the ridge of the roof and adapted to ventilate the space or attic 15 subjacent the roof. The third ventilator 14 which is intended for ventilating rooms on a lower level of the building is located for example in the middle of the roof through it too could be disposed adjacent the ridge.

Generally speaking the ventilator 14 according to the invention comprises an opening 16 which is at least partially closed off by an apertured or louvered panel 17 described in detail below.

In practice the ventilator comprises a base plate 18 defining the opening 16. The base plate 18 is adapted to be inserted between the roofing elements 12 and the rafters 11 and lies generally in the plane defined by the flank of the roof in which it is installed. A duct 20 is disposed below the base plate 18 in registry with the opening 16.

In practice, as illustrated, the base plate 18 has a generally quadrangular, and more particularly rectangular, configuration as does the opening 16 therein.

In practice, as is known per se, the panel 17 covers the larger upper part of the opening 16, leaving the passageway 21 in the lower part of the opening 16 free. The panel 17 comprises, as known per se, sloping transverse louvers 22.

According to the invention the louvers 22 alternatively slope in different directions so that louvers 22A slope outwardly and downwardly and louvers 22B slope outwardly and upwardly. Adjacent pairs of louvers 22A, 22B as well as the uppermost and lowermost louvers 22A, 22B converge outwardly and the cross section of louver openings 23 between pairs 22A, 22B of louvers 22 taper outwardly.

In the illustrated embodiments three parallel transverse louver openings 23 are provided between the pairs of outwardly and downwardly sloping louvers 22A and outwardly and upwardly sloping louvers 22B having the same height from the base plate 18 and defining the same absolute angle with respect to the base plate 18. The louvers 22A, 22B open outwardly and the louver openings 18 lie in a plane parallel to the base plate 18.

Further, in the illustrated embodiment adjacent louver openings 23 are separated by a pair of adjoining louvers 22A and 22B which are V-shaped in cross-section and devoid of any louver opening.

Preferably, as shown, at least one of the endmost louvers 22A, 22B is in continuity at its base with a flat cross member. In the illustrated embodiments both endmost louvers 22A, 22B are respectively in continuity at their bases with flat cross members 24A, 24B.

In practice, cross members 24A, 24B are coplanar and together are part of the same flange 25 surrounding the louvers 22A, 22B and define the upper and lower margins of the flange 25. The width of the larger, upper cross member or margin 24A being $L_A$ and the width of the smaller, lower cross member or margin 24B being $L_B$.

Preferably, as shown, the pairs of louvers 22A, 22B defining the louver openings 23 are joined by sidewalls 26 which preferably slope from the base plate 18 and converge outwardly.

Preferably, the louver openings 23 protrude from the flange 25 lying in the plane of the base plate 18 and are of truncated pyramid shape.

As is known per se, at least the lower part of the bottom wall 27 of the duct 20 slopes toward and joins the lower transverse edge of opening 16 in base plate 18. In practice, the bottom wall 27 of the duct has an inclined section 28 along only part of its length running from a position in registry with the lowermost louver 22A of panel 17. The remaining part 29 of the length of the bottom wall 27 of the duct 20 is parallel to the base plate 18.

As is known per se the duct 20 is of U-shaped cross section, sidewalls 30 joining the bottom wall 18 directly to the base plate 18 of the ventilator. The duct lies within the overall confines of the base plate 18.

Preferably, for reasons which will become apparent below, the upper or upstream end 31 of the duct 20 which is also the free edge thereof, is in vertical alignment with the corresponding upper transverse edge of the opening 16 in the base plate 18.

In practice, the depth of the duct 20 is relatively small and in any event less than the usual thickness of the rafters 11.

According to another feature of the invention the base plate 18 has an outwardly projecting ridge 32 beyond the lower transverse edge of the opening 16 in base plate 18. Preferably, as shown, the upper transverse wall or side 33 of the projecting ridge 32 is in continuity with the inclined section 28 of the bottom wall 27 of the duct and the lower transverse wall or side 34 of the projecting ridge 32 slopes in the same direction as the transverse louvers 22B of the panel 17.

Likewise, according to a feature of the invention, in vertical alignment with at least one of the louver openings 23 in the panel 17 the inclined section 28 of the bottom wall 27 of the duct 20 forms an upwardly protruding step 35, the riser portion 36 of the step 35 sloping in the same direction as the outwardly and upwardly sloping transverse louvers 22B.

In the illustrated embodiments a single protruding step 35 is provided in vertical alignment with the lowermost louver opening 23 of the panel 17. It is self-evident that such a protruding step may be provided in vertical alignment with another or all of the louver openings 23.

In the illustrated embodiments the duct 20 is in one-piece construction with the base plate 18. For example the duct 20 and base plate 18 may be of molded plastic and the fact that the upper edge 31 of the duct 20 lies in vertical alignment with the corresponding upper transverse edge of the opening 16 in the base 18 obviously facilitates the molding of such a part.

The panel 17 and its flange 25 form a part separate from the duct 20 and is suitably secured thereto. In practice, the base plate 18 has a rabbet 37 along the edge of the flange 25 for mounting the panel 17.

In any event it follows from the foregoing description that the passageway 21 left open by the panel 17 is defined between the lower transverse edge of the flat cross member 24B or lower margin of the flange 25 of the panel 17 and the inclined section 28 of the bottom wall 27 of the duct.

In case of snow or rain without any wind the precipitation which enters the duct through the louver openings 23 is exhausted through passageway 21 to the surroundings since the inclined section 28 of the bottom wall 27 of the duct 20 slopes downwards back toward the roof.

It will be assumed, first of all, that in case of wind a current of air is produced rising along the side of the roof in which the ventilator is installed as schematically represented by arrow F1 in FIGS. 1 and 3.

Because of the projecting ridge 32 of the base plate 18 and the upwardly and outwardly sloping louvers 22B of the panel 17 the current of air is deflected upwards as represented by arrows F2 in FIG. 3. This current of air in turn produces a flow of air moving outwardly through the louver openings 23 as represented by arrows F3 in FIG. 3. Should the current of air enter through passageway 21, the protruding step 35 in the inclined section 28 of the bottom wall 27 of the duct 20 will deflect the air, as represented by arrow F4, back to the louver opening 23 thereabove.

Owing to the outwardly and downwardly sloping louvers 22A the result is the same when the current of air produced by the wind descends along the side of the roof in which the ventilator is installed or in other words when the current of air moves in the opposite direction of the arrows F1 in FIG. 3.

Thus, in either case, wind causes a suction effect or negative pressure inside the ventilator drawing air from the attic or rooms below in the direction of arrows F5 in FIG. 1 and outwardly through the louver openings 23.

When the ventilators 14 are used for ventilating the attic 15, special aerating means may be used in association with the ventilators according to the invention for carrying air into the attic 15 and are installed at the lower edge of the roof. As such aerating means are not part of the present invention they will not be described herein. They may be simple openings, preferably with an apertured panel or screen and/or liners having such openings.

When the ventilator 14 is used for ventilating rooms on lower levels in the building, the free end 31 of the duct 20 is closed off by a panel 38 and another duct 39 running to the room or rooms to be ventilated is connected to the bottom wall 27 of duct 20.

In the embodiment of FIGS. 2–5 the panel 17 is permanently secured by adhesive bonding or welding jointly to the base plate 18 and the duct 20 in the rabbet 37 of the base plate 18.

In the FIGS. 6–9 embodiment the panel 17 is removable. For example, as shown, the panel 17 has along its upper margin 24A at least one tongue 40 adapted to receive the rabbet 37 of the base plate 18. In practice two suitably spaced tongues 40 are provided along the upper margin 24A.

In this embodiment the panel 17 has a depending lug 42 along one of its lateral sides, proximate to the lower margin 24B which is adapted to interfit releasably with the corresponding sidewall 30 of the duct 20. For example, as shown, detent means are provided for this purpose on the lug 42 and the sidewall 30. As illustrated the detent means comprise bosses or dimples 43 formed on the lug 42 adapted to be releasably received in complementary recesses 44 in the sidewall 30.

As will be readily understood, the panel 17 is pivoted into position. First, the panel 17 is oriented in an inclined position, engaging the tongues 40 on the edge of the rabbet 37 of the base plate 18, then it is lowered until the tongue 40 is fitted on the rabbet 37 and the lugs are in engagement with sidewalls 30 of the duct, there being sufficient clearance between the tongues 40 and the edge of the rabbet 37 to enable such pivoting movement. The panel 17 may be removed by reversing the foregoing steps.

Removal of the panel 17 frees the entire opening 16 and provides access to the duct and the interior of the attic 15, for example for securing a scaffold mounting to one of the structural members of the frame, i.e., the rafters or the purloins.

In the FIGS. 6–9 embodiment each of the louver openings 23 has a screen or grill comprising a network of bars 45 formed in one piece with the adjoining louvers 22.

The invention is not intended to be limited to the illustrated and described embodiments but covers all alternatives and modifications which will be understood to those skilled in the art without departing from the spirit and scope of the invention.

For example, the number of the louver openings and/or the angle of the slope of the louvers are a matter of design choice.

Further, the slope and height of the outwardly and upwardly and outwardly and downwardly sloping louvers delimiting a louver opening are not necessarily the same. On the contrary depending on the type of roof, and/or the prevailing climatic conditions, the slope and/or height of the louvers may be varied. The louver openings may thus lie in a plane at an angle to the base plate provided that the pairs of louvers defining a louver opening slope in opposite directions relative to each other.

Finally, the width of the louver openings and/or their spacing may be as desired. The spacing is, however, preferably of the same order of magnitude as the width, and the width is established so that taking into account the number of louver openings and any particular conditions of use the sought after ventilation is satisfactory.

What I claim is:

1. A roof ventilator intended to be mounted in a sloping roof and having an upper end and a lower end, said ventilator comprising means defining an opening having an upper end and a lower end, a panel at least partially covering said opening, said panel having a plurality of pairs of transverse louvers defining louver openings, said louver openings being elongated and extending generally in the same direction as said upper and lower ends, alternate endmost ones of said louvers converging outwardly of said panel and the cross section of said louver openings being of outwardly tapering truncated configuration.

2. The roof ventilator according to claim 1, wherein at least one of said endmost louvers is in continuity at its base with a flat cross member.

3. The roof ventilator according to claim 1, wherein both of said endmost louvers are in continuity at their bases with respective flat cross members.

4. The roof ventilator according to claim 1, wherein said means defining an opening comprises a base plate adapted to be inserted in a roof assembly, said panel covering a large upper part of said opening with there being a small passageway remaining at a lower part of said opening.

5. The roof ventilator according to claim 4, further comprising a duct in continuity with said opening, said duct including a bottom wall having an inclined section sloping toward and connected to the lower transverse edge of said opening, a ridge projecting from said base plate beyond the lower transverse edge of said opening.

6. The roof ventilator according to claim 5, the upper side of said projecting ridge is in continuity with the inclined section of the bottom wall of said duct.

7. The roof ventilator according to claim 6, wherein the lower side of said projecting ridge of the base plate slopes in the same direction as the lowermost louver.

8. The roof ventilator according to claim 6, wherein said inclined section of said bottom wall of said duct includes a protruding step in vertical alignment with at least one of said louver openings.

9. The roof ventilator according to claim 6, wherein the upper end of said duct is in vertical alignment with the corresponding upper transverse edge of said opening in said base plate.

10. The roof ventilator according to claim 6, wherein said duct is in one-piece construction with said base plate and said panel forms a part separate from said duct and base plate.

11. The roof ventilator according to claim 10, wherein said base plate has a rabbet bordering said opening for receiving said panel.

12. The roof ventilator according to claim 1, wherein said panel is removably mounted in said opening.

13. The roof ventilator according to claim 1, said roof ventilator having outwardly projecting means for deflecting air and causing air to flow outwardly through said louver openings, said projecting means being distinct and spaced from said transverse louvers.

14. The roof ventilator according to claim 13, wherein said projecting means comprises a ridge projecting outwardly relative to said panel and disposed beyond a lowermost one of said louvers for introducing a flow of air outwardly through at least one of said louver openings.

15. The roof ventilator according to claim 13, wherein said projecting means comprises a protruding step in vertical alignment with at least one of said louver openings for deflecting air to the said one louver opening thereabove.

16. The roof ventilator according to claim 14, wherein said projecting means further comprises a protruding step in vertical alignment with at least one of said louver openings for deflecting air to said one louver opening thereabove.

17. The roof ventilator according to claim 1, wherein outer edges of said pairs of louvers define a plane substantially parallel to said panel.

18. The roof ventilator according to claim 1, wherein said pairs of louvers define elongated truncated pyramids with open bases, the larger of the bases lying generally in the plane of said panel.

19. The roof ventilator according to claim 13, wherein said projecting means is formed in one piece with said means defining an opening.

20. A roof ventilator comprising a base member having an opening with upper and lower transverse edges, a panel having upper and lower transverse edges, said panel being carried by said base and partially covering said opening, a passageway between the lower transverse edge of said panel and the lower transverse edge of said opening, said panel defining a plurality of pairs of transverse louvers defining louver openings, said pairs of louvers converging outwardly of said panel, one of said louvers of each of said pairs of louvers sloping outwardly and upwardly and the other louver of each of said pairs of louvers sloping outwardly and downwardly, and the pairs of transverse louvers being of truncated cross-sectional configuration and the louver openings tapering outwardly.

21. The roof ventilator according to claim 20, wherein the endmost louvers converge outwardly of said panel.

22. The roof ventilator according to claim 21, wherein a duct is in registry with said opening, said duct including a bottom wall having an inclined section sloping toward and connected to the lower transverse edge of said opening in said base member, a ridge projecting from said base member beyond the lower transverse edge of said opening.

23. The roof ventilator according to claim 21, wherein said outwardly and upwardly sloping louvers are parallel to one another and said outwardly and downwardly sloping louvers are parallel to one another.

24. The roof ventilator according to claim 20, said roof ventilator having projecting means for deflecting air and causing air to flow outwardly through said louver openings, said projecting means being distinct from said transverse louvers.

25. The roof ventilator according to claim 24, wherein said projecting means comprises a ridge projecting outwardly from said base member and disposed beyond the lower transverse edge of said openings for inducing a flow of air outwardly through at least said louver opening closest to said passageway.

26. The roof ventilator according to claim 24, wherein said projecting means comprises a protruding step in vertical alignment with at least one of said louver openings for deflecting air to the said one louver opening thereabove.

27. The roof ventilator according to claim 25, wherein said projecting means further comprising a protruding step in vertical alignment with at least one of said louver openings for deflecting air to said one louver opening thereabove.

28. The roof ventilator according to claim 20, wherein outer edges of said pairs of louvers define a plane substantially parallel to said panel.

29. The roof ventilator according to claim 20, wherein said pairs of louvers define elongated truncated pyramids with open bases, the larger of the bases lying generally in the plane of said panel.

* * * * *